US008316557B2

(12) United States Patent
Burnett

(10) Patent No.: US 8,316,557 B2
(45) Date of Patent: Nov. 27, 2012

(54) RECLAMATION OF COMPONENTS OF WELLBORE CUTTINGS MATERIAL

(75) Inventor: George Alexander Burnett, Scotland (GB)

(73) Assignee: Varco I/P, Inc., Houston, TX (US)

( * ) Notice: Subject to any disclaimer, the term of this patent is extended or adjusted under 35 U.S.C. 154(b) by 0 days.

(21) Appl. No.: 12/469,851

(22) Filed: May 21, 2009

(65) Prior Publication Data

US 2009/0227477 A1 Sep. 10, 2009

Related U.S. Application Data

(62) Division of application No. 11/543,301, filed on Oct. 4, 2006, now abandoned.

(51) Int. Cl.
*F26B 11/02* (2006.01)

(52) U.S. Cl. ..... 34/314; 34/323; 34/326; 507/100; 175/66; 175/207; 210/360.1; 210/787

(58) Field of Classification Search ..... 34/310, 34/311, 314, 320, 321, 323, 326, 413, 497; 507/100, 199, 244; 210/300.1, 787, 804, 210/806; 175/66, 207
See application file for complete search history.

(56) References Cited

U.S. PATENT DOCUMENTS

| | | | | |
|---|---|---|---|---|
| 1,830,792 | A | 11/1931 | Herrmann | 209/401 |
| 1,885,154 | A | 11/1932 | Strezynski et al. | |
| 1,886,174 | A | 11/1932 | Hazeltine | 209/269 |
| 2,082,513 | A | 6/1937 | Roberts | 210/76 |
| 2,089,548 | A | 8/1937 | Frantz et al. | 210/389 |
| 2,112,784 | A * | 3/1938 | McNitt | 426/311 |
| 2,341,169 | A | 2/1944 | Wilson et al. | 73/51 |
| 2,418,529 | A * | 4/1947 | Stern | 51/308 |
| 2,446,293 | A | 8/1948 | Minyard | |
| 2,578,456 | A | 12/1951 | Smith | 233/7 |
| 2,653,521 | A | 9/1953 | Einarsson | 209/70 |
| 2,711,854 | A | 6/1955 | Kjellgren | 494/53 |
| 2,716,493 | A | 8/1955 | Hutchison | 209/269 X |
| 2,750,043 | A | 6/1956 | Thompson | 210/149 |
| 2,895,669 | A | 7/1959 | Bobo | 494/10 |
| 2,919,898 | A | 1/1960 | Marwil et al. | 255/1.8 |
| 2,928,546 | A | 3/1960 | Church | 210/319 |
| 2,938,393 | A | 5/1960 | Dunn et al. | 74/61 |
| 2,942,731 | A | 6/1960 | Soldini | 209/293 |
| 2,955,753 | A | 10/1960 | O'Conor et al. | 494/5 |

(Continued)

FOREIGN PATENT DOCUMENTS

DE 4127929 A1 * 2/1993

(Continued)

OTHER PUBLICATIONS

U.S. Appl. No. 12/481,959 Final Office Action dated Oct. 27, 2010.

(Continued)

*Primary Examiner* — Stephen M. Gravini
(74) *Attorney, Agent, or Firm* — Williams, Morgan & Amerson, P.C.

(57) ABSTRACT

A screen assembly for a shale shaker comprising a panel (500) and a support structure (600), the panel (500) having an area provided with a multiplicity of apertures and at least one layer of screening material arranged over the multiplicity of apertures, wherein said panel (500) is removable from said support structure (600).

15 Claims, 4 Drawing Sheets

U.S. PATENT DOCUMENTS

| | | | | | |
|---|---|---|---|---|---|
| 2,961,154 | A | | 11/1960 | Bergey | 494/1 |
| 3,012,674 | A | | 12/1961 | Hoppe | 209/401 |
| 3,053,379 | A | | 9/1962 | Roder et al. | 198/220 |
| 3,064,806 | A | | 11/1962 | Tapani | 209/17 |
| 3,070,291 | A | | 12/1962 | Bergey | 494/1 |
| 3,219,107 | A | | 11/1965 | Brown et al. | 166/8 |
| 3,226,989 | A | | 1/1966 | Robins | 74/87 |
| 3,268,159 | A | | 8/1966 | Kern | 233/7 |
| 3,302,720 | A | * | 2/1967 | Brandon | 166/249 |
| 3,498,393 | A | | 3/1970 | West et al. | 175/48 |
| 3,605,919 | A | | 9/1971 | Bromell et al. | 175/27 |
| 3,629,859 | A | | 12/1971 | Copland et al. | 340/172.5 |
| 3,640,344 | A | * | 2/1972 | Brandon | 166/249 |
| 3,659,465 | A | | 5/1972 | Oshima et al. | 74/61 |
| 3,726,136 | A | | 4/1973 | McKean et al. | 73/155 |
| 3,795,361 | A | | 3/1974 | Lee | 233/7 |
| 3,796,299 | A | | 3/1974 | Musschoot | 198/220 |
| 3,855,380 | A | * | 12/1974 | Gordon et al. | 264/37.31 |
| 3,874,733 | A | * | 4/1975 | Poundstone et al. | 299/17 |
| 3,885,734 | A | | 5/1975 | Lee | 233/3 |
| 3,900,393 | A | | 8/1975 | Wilson | 209/399 |
| 3,934,792 | A | | 1/1976 | High et al. | 233/7 |
| 3,955,411 | A | | 5/1976 | Lawson, Jr. | 73/155 |
| 3,968,033 | A | | 7/1976 | Illemann et al. | 209/403 |
| 3,993,146 | A | * | 11/1976 | Poundstone et al. | 175/206 |
| 4,000,074 | A | | 12/1976 | Evans | 210/369 |
| 4,033,865 | A | | 7/1977 | Derrick, Jr. | 209/275 |
| 4,038,152 | A | * | 7/1977 | Atkins | 201/2.5 |
| 4,082,657 | A | | 4/1978 | Gage | 209/311 |
| 4,085,888 | A | | 4/1978 | Jager | 233/7 |
| 4,115,507 | A | | 9/1978 | Pico et al. | 264/267 |
| 4,116,288 | A | | 9/1978 | Love | 175/66 |
| 4,175,039 | A | | 11/1979 | Fisher | 210/74 |
| 4,192,743 | A | | 3/1980 | Bastgen et al. | 210/712 |
| 4,208,906 | A | | 6/1980 | Roberts, Jr. | 73/155 |
| 4,209,381 | A | | 6/1980 | Kelly, Jr. | 208/8 LE |
| 4,212,731 | A | | 7/1980 | Wallin et al. | 209/366.5 |
| 4,222,988 | A | | 9/1980 | Barthel | 422/309 |
| 4,224,821 | A | | 9/1980 | Taylor et al. | 73/32 R |
| 4,228,949 | A | | 10/1980 | Jackson | 233/7 |
| 4,233,181 | A | * | 11/1980 | Goller et al. | 502/101 |
| 4,240,578 | A | | 12/1980 | Jackson | 233/7 |
| 4,242,146 | A | | 12/1980 | Kelly, Jr. | 134/7 |
| 4,297,225 | A | | 10/1981 | Hartley | 210/779 |
| 4,298,160 | A | | 11/1981 | Jackson | 233/7 |
| 4,298,162 | A | | 11/1981 | Hohne | 233/7 |
| 4,298,572 | A | | 11/1981 | Moffet et al. | 422/68 |
| 4,306,974 | A | | 12/1981 | Harry | 210/388 |
| 4,319,482 | A | | 3/1982 | Bunner | 73/153 |
| 4,319,991 | A | | 3/1982 | Crone, Jr. et al. | 209/255 |
| 4,322,288 | A | | 3/1982 | Schmidt | 209/356 |
| 4,339,072 | A | | 7/1982 | Hiller | 233/7 |
| 4,350,591 | A | | 9/1982 | Lee | 210/384 |
| 4,369,915 | A | | 1/1983 | Oberg et al. | 494/8 |
| 4,378,906 | A | | 4/1983 | Epper et al. | 494/54 |
| 4,411,074 | A | * | 10/1983 | Daly | 34/479 |
| 4,432,064 | A | | 2/1984 | Barker et al. | 364/550 |
| 4,446,022 | A | | 5/1984 | Harry | 210/388 |
| 4,459,207 | A | | 7/1984 | Young | 209/269 |
| 4,482,459 | A | * | 11/1984 | Shiver | 210/639 |
| 4,495,065 | A | | 1/1985 | DeReamer et al. | 209/243 |
| 4,526,687 | A | * | 7/1985 | Nugent | 210/202 |
| 4,536,286 | A | | 8/1985 | Nugent | 210/202 |
| 4,546,783 | A | | 10/1985 | Lott | 134/109 |
| 4,549,431 | A | | 10/1985 | Soeiinah | 73/152.49 |
| 4,553,429 | A | | 11/1985 | Evans et al. | 73/152.21 |
| 4,573,115 | A | | 2/1986 | Halgrimson | 364/138 |
| 4,575,336 | A | * | 3/1986 | Mudd et al. | 432/72 |
| 4,606,415 | A | | 8/1986 | Gray, Jr. et al. | 175/24 |
| 4,624,417 | A | * | 11/1986 | Gangi | 241/17 |
| 4,634,535 | A | | 1/1987 | Lott | 210/780 |
| 4,635,735 | A | | 1/1987 | Crownover | 175/48 |
| 4,639,258 | A | | 1/1987 | Schellstede et al. | 95/260 |
| 4,650,687 | A | * | 3/1987 | Willard et al. | 426/438 |
| 4,668,213 | A | | 5/1987 | Kramer | 494/8 |
| 4,685,329 | A | | 8/1987 | Burgess | 73/151 |
| 4,696,353 | A | | 9/1987 | Elmquist et al. | 175/206 |
| 4,696,751 | A | | 9/1987 | Eifling | 210/780 |
| 4,729,548 | A | * | 3/1988 | Sullins | 266/225 |
| D296,027 | S | | 5/1988 | Dietzen | D34/39 |
| 4,743,226 | A | | 5/1988 | Day et al. | 494/53 |
| 4,751,887 | A | * | 6/1988 | Terry et al. | 588/321 |
| 4,770,711 | A | * | 9/1988 | Deal et al. | 134/18 |
| 4,783,057 | A | * | 11/1988 | Sullins | 266/44 |
| 4,791,002 | A | * | 12/1988 | Baker et al. | 426/641 |
| 4,793,421 | A | | 12/1988 | Jasinski | 175/27 |
| 4,795,552 | A | | 1/1989 | Yun et al. | 209/319 |
| 4,799,987 | A | * | 1/1989 | Sullins | 156/425 |
| 4,805,659 | A | | 2/1989 | Gunnewig et al. | 137/118 |
| 4,807,469 | A | | 2/1989 | Hall | 73/155 |
| 4,809,791 | A | | 3/1989 | Hayatdavoudi | 175/40 |
| 4,832,853 | A | | 5/1989 | Shiraki et al. | 210/781 |
| 4,844,106 | A | | 7/1989 | Hunter et al. | 134/73 |
| 4,846,352 | A | | 7/1989 | Bailey | 209/399 |
| 4,857,176 | A | | 8/1989 | Derrick et al. | 209/392 |
| 4,882,054 | A | | 11/1989 | Derrick et al. | 210/389 |
| 4,889,733 | A | * | 12/1989 | Willard et al. | 426/438 |
| 4,889,737 | A | * | 12/1989 | Willard et al. | 426/550 |
| 4,895,665 | A | * | 1/1990 | Colelli et al. | 210/710 |
| 4,895,731 | A | * | 1/1990 | Baker et al. | 426/641 |
| 4,896,835 | A | | 1/1990 | Fahrenholz | 241/74 |
| 4,911,834 | A | | 3/1990 | Murphy | 210/167 |
| 4,915,452 | A | * | 4/1990 | Dibble | 299/17 |
| 4,940,535 | A | | 7/1990 | Fisher et al. | 209/260 |
| 4,942,929 | A | * | 7/1990 | Malachosky et al. | 175/66 |
| 4,961,722 | A | | 10/1990 | Taylor et al. | 494/36 |
| 5,010,966 | A | | 4/1991 | Stokley et al. | 175/66 |
| 5,053,082 | A | * | 10/1991 | Flanigan et al. | 134/25.1 |
| 5,066,350 | A | * | 11/1991 | Sullins | 156/187 |
| 5,080,721 | A | * | 1/1992 | Flanigan et al. | 134/26 |
| 5,107,874 | A | * | 4/1992 | Flanigan et al. | 134/60 |
| 5,109,933 | A | * | 5/1992 | Jackson | 175/66 |
| 5,129,469 | A | * | 7/1992 | Jackson | 175/66 |
| 5,131,271 | A | | 7/1992 | Haynes et al. | 73/290 |
| 5,145,256 | A | * | 9/1992 | Wiemers et al. | 366/336 |
| 5,147,277 | A | | 9/1992 | Shapiro | 494/53 |
| 5,156,749 | A | | 10/1992 | Williams | 210/770 |
| 5,156,751 | A | | 10/1992 | Miller | 210/787 |
| 5,181,578 | A | * | 1/1993 | Lawler | 175/424 |
| 5,190,645 | A | | 3/1993 | Burgess | 210/144 |
| 5,200,372 | A | * | 4/1993 | Kuroyama et al. | 501/96.4 |
| 5,203,762 | A | | 4/1993 | Cooperstein | 494/7 |
| 5,221,008 | A | | 6/1993 | Derrick, Jr. et al. | 209/269 |
| D337,809 | S | | 7/1993 | Dietzen | D23/202 |
| 5,226,546 | A | | 7/1993 | Janssens et al. | 209/319 |
| 5,227,057 | A | * | 7/1993 | Lundquist | 210/174 |
| 5,229,018 | A | | 7/1993 | Forrest | 252/8.551 |
| 5,232,099 | A | | 8/1993 | Maynard | 209/311 |
| 5,248,222 | A | | 9/1993 | Littman et al. | 406/142 |
| 5,253,718 | A | * | 10/1993 | Lawler | 175/20 |
| 5,265,730 | A | | 11/1993 | Norris et al. | 209/326 |
| 5,273,112 | A | | 12/1993 | Schultz | 166/374 |
| 5,278,549 | A | | 1/1994 | Crawford | 340/853.2 |
| 5,303,786 | A | | 4/1994 | Prestridge et al. | 175/66 |
| 5,314,058 | A | | 5/1994 | Graham | 198/753 |
| 5,319,972 | A | | 6/1994 | Oblak et al. | 73/290 |
| 5,329,465 | A | | 7/1994 | Arcella et al. | 364/551.01 |
| 5,332,101 | A | | 7/1994 | Bakula | 209/403 |
| 5,337,966 | A | * | 8/1994 | Francis et al. | 241/46.06 |
| 5,378,364 | A | | 1/1995 | Welling | 210/512.1 |
| 5,385,669 | A | | 1/1995 | Leone, Sr. | 210/488 |
| 5,392,925 | A | | 2/1995 | Seyffert | 209/405 |
| 5,400,376 | A | | 3/1995 | Trudeau | 377/21 |
| 5,403,260 | A | | 4/1995 | Hensely | 494/53 |
| 5,431,236 | A | | 7/1995 | Warren | 175/66 |
| 5,454,957 | A | | 10/1995 | Roff | 210/768 |
| 5,465,798 | A | | 11/1995 | Edlund et al. | 175/24 |
| 5,474,142 | A | | 12/1995 | Bowden | 175/27 |
| 5,488,104 | A | * | 1/1996 | Schulz | 536/86 |
| 5,489,204 | A | * | 2/1996 | Conwell et al. | 432/153 |
| 5,494,584 | A | | 2/1996 | McLachlan et al. | 210/739 |
| 5,516,348 | A | * | 5/1996 | Conwell et al. | 51/309 |
| 5,534,207 | A | * | 7/1996 | Burrus | 264/150 |
| 5,547,479 | A | * | 8/1996 | Conwell et al. | 51/309 |
| 5,566,889 | A | * | 10/1996 | Preiss | 241/19 |
| 5,567,150 | A | * | 10/1996 | Conwell et al. | 432/14 |
| 5,570,749 | A | * | 11/1996 | Reed | 175/66 |

5,593,582 A 1/1997 Roff, Jr. ..... 210/325
5,597,042 A 1/1997 Tubel et al. ..... 166/250.01
5,632,714 A 5/1997 Leung et al. ..... 494/53
5,638,960 A 6/1997 Beuermann et al. ..... 209/397
5,641,070 A 6/1997 Seyffert ..... 209/314
5,643,169 A 7/1997 Leung et al. ..... 494/53
5,653,674 A 8/1997 Leung ..... 494/53
5,662,165 A 9/1997 Tubel et al. ..... 166/250.01
5,662,169 A 9/1997 Hosie ..... 166/344
5,669,941 A * 9/1997 Peterson ..... 51/295
5,681,256 A 10/1997 Nagafuji ..... 494/9
D386,874 S 11/1997 Glaun ..... D34/29
D387,534 S 12/1997 Glaun ..... D34/29
D388,583 S 12/1997 Glaun ..... D34/29
5,695,442 A 12/1997 Leung et al. ..... 494/37
5,699,918 A 12/1997 Dunn ..... 209/397
D388,924 S 1/1998 Glaun ..... D34/29
5,706,896 A 1/1998 Tubel et al. ..... 166/313
5,730,219 A 3/1998 Tubel et al. ..... 166/250.01
5,732,776 A 3/1998 Tubel et al. ..... 166/250.15
5,732,828 A 3/1998 Littlefield, Jr. ..... 209/365.1
5,771,601 A 6/1998 Veal et al. ..... 34/314
5,772,573 A 6/1998 Hao ..... 494/15
5,791,494 A 8/1998 Meyer ..... 209/368
5,793,705 A 8/1998 Gazis et al. ..... 367/98
5,811,003 A 9/1998 Young et al. ..... 210/388
5,814,230 A 9/1998 Willis et al. ..... 210/710
5,819,952 A 10/1998 Cook et al. ..... 209/400
5,839,521 A 11/1998 Dietzen ..... 100/37
5,857,955 A 1/1999 Phillips et al. ..... 494/7
5,861,362 A 1/1999 Mayeux et al. ..... 507/104
5,868,125 A * 2/1999 Maoujoud ..... 125/15
5,896,998 A 4/1999 Bjorklund et al. ..... 209/326
5,899,844 A 5/1999 Eberle, Sr. ..... 494/37
5,913,767 A 6/1999 Feldkamp et al. ..... 494/4
5,919,123 A 7/1999 Phillips ..... 494/7
5,942,130 A 8/1999 Leung ..... 210/784
5,944,197 A 8/1999 Baltzer et al. ..... 209/400
5,948,256 A 9/1999 Leung ..... 210/374
5,948,271 A 9/1999 Wardwell et al. ..... 210/739
5,952,569 A 9/1999 Jervis et al. ..... 73/152.01
5,955,666 A 9/1999 Mullins ..... 73/152.18
5,958,235 A 9/1999 Leung ..... 210/374
5,971,084 A 10/1999 Dietzen ..... 175/66
5,971,159 A 10/1999 Leone et al. ..... 209/399
5,971,307 A * 10/1999 Davenport ..... 241/259.1
5,975,204 A 11/1999 Tubel et al. ..... 166/250.15
5,992,519 A 11/1999 Ramakrishnan et al. 166/250.15
5,996,484 A 12/1999 Reddoch ..... 100/37
6,012,016 A 1/2000 Bilden et al. ..... 702/12
6,013,158 A * 1/2000 Wootten ..... 202/99
6,021,377 A 2/2000 Dubinsky et al. ..... 702/9
6,024,228 A 2/2000 Williams ..... 209/272
6,045,070 A * 4/2000 Davenport ..... 241/60
6,062,070 A 5/2000 Maltby et al. ..... 73/61.49
6,063,292 A 5/2000 Leung ..... 210/739
6,089,380 A 7/2000 Hazrati et al. ..... 210/411
6,102,310 A * 8/2000 Davenport ..... 241/21
6,105,689 A 8/2000 McGuire et al. ..... 175/48
6,106,733 A 8/2000 Wood ..... 210/774
6,109,452 A 8/2000 Leung et al. ..... 210/369
6,110,096 A 8/2000 Leung et al. ..... 494/53
6,123,656 A 9/2000 Michelsen ..... 494/54
6,138,834 A 10/2000 Southall ..... 209/17
6,143,183 A 11/2000 Wardwell et al. ..... 210/739
6,145,669 A 11/2000 Leung ..... 210/374
6,155,428 A 12/2000 Bailey et al. ..... 209/315
6,161,700 A 12/2000 Bakula ..... 209/401
6,165,323 A 12/2000 Shearer ..... 162/251
6,170,580 B1 * 1/2001 Reddoch ..... 175/66
6,173,609 B1 1/2001 Modlin et al. ..... 73/293
6,176,323 B1 1/2001 Weirich et al. ..... 175/40
6,179,128 B1 1/2001 Seyffert ..... 209/405
6,192,742 B1 2/2001 Miwa et al. ..... 73/40
6,192,980 B1 2/2001 Tubel et al. ..... 166/65.1
6,217,830 B1 4/2001 Roberts et al. ..... 422/140
6,223,906 B1 5/2001 Williams ..... 210/400
6,233,524 B1 5/2001 Harrell et al. ..... 702/9
6,234,250 B1 5/2001 Green et al. ..... 166/250.03
6,237,404 B1 5/2001 Crary et al. ..... 73/152.03
6,244,362 B1 6/2001 Williams ..... 175/206
6,267,250 B1 7/2001 Leung et al. ..... 210/369
6,279,471 B1 8/2001 Reddoch ..... 100/37
D448,488 S 9/2001 Chaffiotte et al. ..... D24/219
6,283,302 B1 9/2001 Schulte et al. ..... 209/399
6,290,636 B1 9/2001 Hiller, Jr. et al. ..... 494/53
6,308,787 B1 10/2001 Alft ..... 175/48
6,315,894 B1 11/2001 Wiemers et al. ..... 210/96.1
6,321,860 B1 11/2001 Reddoch ..... 175/206
6,333,700 B1 12/2001 Thomeer et al. ..... 340/854.8
6,346,813 B1 2/2002 Kleinberg ..... 324/303
6,349,834 B1 2/2002 Carr et al. ..... 209/366.5
6,352,159 B1 3/2002 Loshe ..... 209/268
6,356,205 B1 3/2002 Salvo et al. ..... 340/853.3
6,367,633 B1 4/2002 Douglas ..... 209/311
6,368,264 B1 4/2002 Phillips et al. ..... 494/5
6,371,301 B1 4/2002 Schulte et al. ..... 209/405
6,378,628 B1 4/2002 McGuire et al. ..... 175/48
6,393,363 B1 5/2002 Wilt et al. ..... 702/6
6,399,851 B1 6/2002 Siddle ..... 203/87
6,408,953 B1 6/2002 Goldman et al. ..... 175/39
6,412,644 B1 7/2002 Crabbe et al. ..... 209/309
6,429,653 B1 8/2002 Kruspe et al. ..... 324/303
6,438,495 B1 8/2002 Chau et al. ..... 702/9
6,439,391 B1 8/2002 Seyffert ..... 209/238
6,461,286 B1 10/2002 Beatley ..... 494/8
6,474,143 B1 11/2002 Herod ..... 73/54.01
6,484,088 B1 11/2002 Reimer ..... 701/123
6,485,640 B2 11/2002 Fout et al. ..... 210/188
6,505,682 B2 1/2003 Brockman ..... 166/250.15
6,506,310 B2 1/2003 Kulbeth ..... 210/780
6,510,947 B1 1/2003 Schulte et al. ..... 210/388
6,513,664 B1 2/2003 Logan et al. ..... 209/367
6,517,733 B1 2/2003 Carlson ..... 210/785
6,519,568 B1 2/2003 Harvey et al. ..... 705/1
6,530,438 B1 3/2003 McIntyre ..... 175/66
6,530,482 B1 3/2003 Wiseman ..... 209/253
6,536,540 B2 3/2003 deBoer ..... 175/70
6,553,316 B2 4/2003 Bary et al. ..... 702/16
6,553,336 B1 4/2003 Johnson et al. ..... 702/188
6,553,901 B2 4/2003 Reddoch ..... 100/45
6,575,304 B2 6/2003 Cudahy ..... 209/365.3
6,581,455 B1 6/2003 Berger et al. ..... 73/152.55
6,585,115 B1 7/2003 Reddoch et al. ..... 209/3
6,600,278 B1 7/2003 Bretzius ..... 318/34
6,601,709 B2 8/2003 Schulte et al. ..... 209/397
6,605,029 B1 8/2003 Koch et al. ..... 494/53
6,640,912 B2 11/2003 Reddoch ..... 175/217
6,662,952 B2 12/2003 Adams et al. ..... 209/319
6,669,027 B1 12/2003 Mooney et al. ..... 209/405
6,679,385 B2 1/2004 Suter et al. ..... 209/367
6,691,025 B2 2/2004 Reimer ..... 701/123
6,693,553 B1 2/2004 Ciglenec et al. ..... 340/853.1
6,715,612 B1 4/2004 Krystof ..... 209/331
6,722,504 B2 4/2004 Schulte et al. ..... 209/359
6,746,602 B2 6/2004 Fout et al. ..... 210/188
6,752,273 B2 6/2004 Reddoch ..... 209/2
6,763,605 B2 7/2004 Reddoch ..... 34/58
6,766,254 B1 7/2004 Bradford et al. ..... 702/9
6,769,550 B2 8/2004 Adams et al. ..... 209/399
6,780,147 B2 8/2004 Koch et al. ..... 494/53
6,783,088 B1 * 8/2004 Gillis et al. ..... 241/19
6,783,685 B2 8/2004 Huang ..... 210/690
6,790,169 B2 9/2004 Koch et al. ..... 494/53
6,793,814 B2 * 9/2004 Fout et al. ..... 210/188
6,808,626 B2 10/2004 Kulbeth ..... 210/241
6,827,223 B2 12/2004 Colgrove et al. ..... 209/365.3
6,838,008 B2 1/2005 Fout et al. ..... 210/780
6,860,845 B1 3/2005 Miller et al. ..... 494/1
6,863,183 B2 3/2005 Schulte et al. ..... 209/405
6,863,809 B2 3/2005 Smith et al. ..... 210/202
6,868,920 B2 3/2005 Hoteit et al. ..... 175/25
6,868,972 B2 3/2005 Seyffert et al. ..... 209/254
6,873,267 B1 3/2005 Tubel et al. ..... 340/853.3
6,892,812 B2 5/2005 Niedermayr et al. .... 166/250.15
6,896,055 B2 5/2005 Koithan ..... 166/250.15
6,899,178 B2 5/2005 Tubel ..... 166/313
6,905,452 B1 6/2005 Kirsch ..... 494/8

| | | | | |
|---|---|---|---|---|
| 6,907,375 | B2 | 6/2005 | Guggari et al. | 702/113 |
| 6,910,411 | B2 | 6/2005 | Reddoch | 100/37 |
| 6,926,101 | B2 | 8/2005 | deBoer | 75/70 |
| 6,932,169 | B2 | 8/2005 | Wylie et al. | 175/66 |
| 6,932,757 | B2 | 8/2005 | Beattey | 494/55 |
| 6,936,092 | B2 | 8/2005 | Seyffert et al. | 95/271 |
| 6,971,982 | B1 | 12/2005 | Kirsch | 494/8 |
| 6,981,940 | B2 | 1/2006 | Rafferty | 494/7 |
| 7,001,324 | B2 | 2/2006 | Hensley et al. | 494/53 |
| 7,018,326 | B2 | 3/2006 | Koch et al. | 494/53 |
| 7,041,044 | B2 | 5/2006 | Gilbert | 494/53 |
| D524,825 | S | 7/2006 | Koch et al. | D15/21 |
| 7,093,678 | B2 | 8/2006 | Risher et al. | 175/66 |
| 7,144,516 | B2 | 12/2006 | Smith | 210/803 |
| 7,175,027 | B2 | 2/2007 | Strong et al. | 209/405 |
| 7,195,084 | B2 | 3/2007 | Burnett et al. | 175/66 |
| 7,198,156 | B2 | 4/2007 | Schulte et al. | 209/309 |
| 7,216,767 | B2 | 5/2007 | Schulte et al. | 209/309 |
| 7,216,768 | B2 | 5/2007 | Fisher et al. | 209/309 |
| 7,228,971 | B2 | 6/2007 | Mooney et al. | 209/396 |
| 7,264,125 | B2 | 9/2007 | Lipa | 209/397 |
| 7,284,665 | B2 | 10/2007 | Fuchs | 209/270 |
| 7,303,079 | B2 | 12/2007 | Reid-Robertson et al. | 209/405 |
| 7,306,057 | B2 | 12/2007 | Strong et al. | 175/66 |
| 7,316,321 | B2 | 1/2008 | Robertson et al. | 209/400 |
| 7,337,860 | B2 | 3/2008 | McIntyre | 175/66 |
| 7,373,996 | B1 | 5/2008 | Martin et al. | 175/206 |
| 7,387,602 | B1 | 6/2008 | Kirsch | 494/8 |
| 7,514,011 | B2 | 4/2009 | Kulbeth | 210/780 |
| 7,540,837 | B2 | 6/2009 | Scott et al. | 494/7 |
| 7,540,838 | B2 | 6/2009 | Scott et al. | 494/7 |
| 7,581,569 | B2 | 9/2009 | Beck | 139/425 R |
| 7,770,665 | B2 * | 8/2010 | Eia et al. | 175/66 |
| 2001/0032815 | A1 | 10/2001 | Adams et al. | 210/388 |
| 2002/0000399 | A1 | 1/2002 | Winkler et al. | 209/399 |
| 2002/0018399 | A1 | 2/2002 | Schultz et al. | 361/81 |
| 2002/0033278 | A1 * | 3/2002 | Reddoch | 175/57 |
| 2002/0033358 | A1 | 3/2002 | Bakula | 209/331 |
| 2002/0035551 | A1 | 3/2002 | Sherwin et al. | 705/412 |
| 2002/0065698 | A1 | 5/2002 | Schick et al. | 705/8 |
| 2002/0112888 | A1 | 8/2002 | Leuchtenberg | 175/48 |
| 2002/0134709 | A1 | 9/2002 | Riddle | 209/238 |
| 2003/0015351 | A1 | 1/2003 | Goldman et al. | 175/39 |
| 2003/0038734 | A1 | 2/2003 | Hirsch et al. | 340/853.1 |
| 2003/0109951 | A1 | 6/2003 | Hsiung et al. | 700/108 |
| 2003/0220742 | A1 | 11/2003 | Niedermayr et al. | 702/9 |
| 2004/0040746 | A1 | 3/2004 | Niedermayr et al. | 175/38 |
| 2004/0051650 | A1 | 3/2004 | Gonsoulin et al. | 340/853.1 |
| 2004/0156920 | A1 * | 8/2004 | Kane | 424/725 |
| 2004/0245155 | A1 | 12/2004 | Strong et al. | 209/405 |
| 2005/0103689 | A1 | 5/2005 | Schulte, Jr. et al. | 209/405 |
| 2005/0153844 | A1 | 7/2005 | McIntyre | 507/100 |
| 2005/0183574 | A1 * | 8/2005 | Burnett et al. | 95/271 |
| 2005/0236305 | A1 | 10/2005 | Schulte, Jr. et al. | 209/403 |
| 2005/0255186 | A1 | 11/2005 | Hiraga | 425/542 |
| 2006/0019812 | A1 | 1/2006 | Stalwick | 494/42 |
| 2006/0034988 | A1 * | 2/2006 | Bresnahan et al. | 426/502 |
| 2006/0081508 | A1 | 4/2006 | Astleford et al. | 209/309 |
| 2006/0102390 | A1 | 5/2006 | Burnett et al. | 175/66 |
| 2006/0105896 | A1 | 5/2006 | Smith et al. | 494/7 |
| 2006/0144779 | A1 | 7/2006 | Bailey | 210/330 |
| 2006/0200328 | A1 | 9/2006 | Guo et al. | 703/10 |
| 2006/0200329 | A1 | 9/2006 | Guo et al. | 703/10 |
| 2006/0278438 | A1 | 12/2006 | Laureano et al. | 175/66 |
| 2007/0108106 | A1 | 5/2007 | Burnett | 209/325 |
| 2007/0131592 | A1 | 6/2007 | Browne et al. | 209/399 |
| 2007/0215386 | A1 * | 9/2007 | Burnett et al. | 175/66 |
| 2008/0078697 | A1 | 4/2008 | Carr | 209/49 |
| 2008/0078702 | A1 | 4/2008 | Carr et al. | 209/326 |
| 2008/0078704 | A1 | 4/2008 | Carr et al. | 209/399 |
| 2008/0093269 | A1 | 4/2008 | Timmerman et al. | 209/405 |
| 2008/0179090 | A1 * | 7/2008 | Eia et al. | 175/5 |
| 2008/0179096 | A1 * | 7/2008 | Eia et al. | 175/66 |
| 2008/0179097 | A1 * | 7/2008 | Eia et al. | 175/66 |
| 2009/0105059 | A1 | 4/2009 | Dorry et al. | 494/37 |
| 2009/0178978 | A1 | 7/2009 | Beebe et al. | 210/747 |
| 2009/0227477 | A1 * | 9/2009 | Burnett | 507/100 |
| 2009/0242466 | A1 | 10/2009 | Burnett et al. | 209/555 |
| 2009/0286098 | A1 * | 11/2009 | Yajima et al. | 428/507 |
| 2009/0316084 | A1 * | 12/2009 | Yajima et al. | 349/96 |
| 2010/0084190 | A1 * | 4/2010 | Eia et al. | 175/5 |
| 2010/0089802 | A1 | 4/2010 | Burnett | 209/360 |
| 2010/0119570 | A1 * | 5/2010 | Potter et al. | 424/422 |

FOREIGN PATENT DOCUMENTS

| | | | | |
|---|---|---|---|---|
| FR | 2611559 | A3 | * | 9/1988 |
| FR | 2 636 669 | | | 3/1990 |
| GB | 1 526 663 | | | 9/1978 |
| GB | 2030482 | A | * | 4/1980 |
| GB | 1 578 948 | | | 11/1980 |
| GB | 2 176 424 | A | | 12/1986 |
| GB | 2 327 442 | A | | 1/1999 |
| GB | 2327442 | A | * | 1/1999 |
| JP | 55112761 | A | * | 8/1980 |
| JP | 59069268 | A | * | 4/1984 |
| JP | 63003090 | A | * | 1/1988 |
| JP | 63283860 | A | * | 11/1988 |
| JP | 63290705 | A | * | 11/1988 |
| JP | 02127030 | A | * | 5/1990 |
| JP | 02167834 | A | * | 6/1990 |
| JP | 03240925 | A | * | 10/1991 |
| JP | 03264263 | A | * | 11/1991 |
| JP | 04093045 | A | * | 3/1992 |
| JP | 04269170 | A | * | 9/1992 |
| JP | 05043884 | A | * | 2/1993 |
| JP | 05301158 | A | * | 11/1993 |
| JP | 06063499 | A | * | 3/1994 |
| JP | 07304028 | A | * | 11/1995 |
| JP | 08039428 | A | * | 2/1996 |
| JP | 08270355 | A | * | 10/1996 |
| JP | 09109032 | A | * | 4/1997 |
| WO | WO96/08301 | | | 3/1996 |
| WO | WO96/33792 | | | 3/1996 |
| WO | WO98/16328 | | | 3/1998 |
| WO | WO 9810895 | A1 | * | 3/1998 |
| WO | WO2004/110589 | A1 | | 12/2004 |
| WO | WO2005/107963 | A2 | | 11/2005 |
| WO | WO2007/070559 | A2 | | 6/2007 |
| WO | WO2009/048783 | A2 | | 4/2009 |

OTHER PUBLICATIONS

U.S. Appl. No. 12/481,959 Office Action dated Jun. 7, 2010.
U.S. Appl. No. 12/227,462 Office Action dated Nov. 15, 2010.
U.S. Appl. No. 11/897,976 Final Office Action dated Sep. 1, 2010.
U.S. Appl. No. 11/897,976 Office Action dated Apr. 1, 2010.
U.S. Appl. No. 11/897,975 Final Office Action dated Jul. 21, 2010.
U.S. Appl. No. 11/897,975 Office Action dated Feb. 19, 2010.
U.S. Appl. No. 11/637,615 Final Office Action dated Aug. 2, 2010.
U.S. Appl. No. 11/637,615 Office Action dated Mar. 2, 2010.
Polyamide 6/6—Nylon 6/6—PA 6/6 60% Glass Fibre Reinforced, Data Sheet [online], AZoM™, The A to Z of Materials and AZojomo, The "AZo Journal of Materials Online" [retrieved on Nov. 23, 2005] (2005) (Retrieved from the Internet: <URL: http://web.archive.org/web/20051123025735/http://www.azom.com/details.asp?ArticleID=493>.
U.S. Appl. No. 12/785,735 Office Action dated Dec. 9, 2011.
U.S. Appl. No. 12/490,492 Office Action dated Oct. 7, 2011.
U.S. Appl. No. 12/321,358 Final Office Action dated Jan. 18, 2012.
U.S. Appl. No. 12/321,358 Office Action dated Aug. 29, 2011.
U.S. Appl. No. 12/287,716 Office Action dated Jun. 17, 2011.
U.S. Appl. No. 12/287,709 Office Action dated Mar. 29, 2011.
U.S. Appl. No. 12/231,293 Office Action dated Sep. 13, 2011.
U.S. Appl. No. 12/228,670 Office Action dated Jun. 20, 2011.
U.S. Appl. No. 12/227,462 Final Office Action dated May 26, 2011.
U.S. Appl. No. 12/008,980 Office Action dated Aug. 31, 2011.
U.S. Appl. No. 12/008,980 Office Action dated Apr. 5, 2011.
U.S. Appl. No. 12/001,479 Final Office Action dated Oct. 31, 2011.
U.S. Appl. No. 12/001,479 Office Action dated Jun. 8, 2011.
U.S. Appl. No. 11/897,975 Office Action dated Jun. 8, 2012.
U.S. Appl. No. 11/897,975 Final Office Action dated Aug. 12, 2011.
U.S. Appl. No. 11/897,975 Office Action dated Mar. 1, 2011.
U.S. Appl. No. 11/637,615 Final Office Action dated Nov. 16, 2011.
U.S. Appl. No. 11/637,615 Office Action dated Jul. 21, 2011.

International Search Report and Written Opinion from PCT/GB2010/051050 dated Jan. 30, 2012.
EP Application No. 07 733 775.6 EPC Communication dated Dec. 9, 2010.
Adams et al., "The Advanced Technology Linear Separator Model ATL-1000," Drexel Oilfield Services, STC 03, 18 pages (1991).
AMS 2000 Description, Thule Rigtech, Rig Technology, 18 pages (2000).
Automated Chemical Additive System, Thule Rigtech, Rig Technology Ltd., 4 pages (2000).
Brandt Automated Shaker Control, Varco, 1 page (2002).
Brandt®, A Varco Company, King Cobra Series, Installation, Operation, and Maintenance Manual, M12444 R5, 65 pages (2003).
Brandt®, A Varco Company, LCM-2D LP Installation and Operation Manual, 84 pages (1998).
Brandt et al., Mud Equipment Manual—Handbook 3: Shale Shakers, Gulf Pub. Co., 18 pages (1982).
The Derrick LP Sandwich Shaker, Derrick Equipment Company, 4 pages (1981).
Fluid Systems Inc., The Prodigy Series 1™ Dynamic Control Shaker, 2 pages (Apr. 27, 2004).
Sweco® Oilfield Services, LM-3 Full-Flo™ Shale Shaker, 4 pages (1991).
Axiom Ax-1 Shaker Brochure, 24 pages (2010).
Brandt, VSM-300™ Shaker Brochure, 4 pages (2001).
Brandt, VSM-Ultra Shaker Brochure, 2 pages (2003).
Brandt, Cuttings Injection Systems and Services (four pages) (1999).
Brandt, FD-25™ Cuttings Box (two pages) (1999).
Fluid Systems Inc., d-Hydrator II™ Horizontal Cuttings Drier (two pages) (2004).
M-I SWACO, Cuttings Re-Injection (eight pages) (2003).
Minton et al., "Annular Reinjection of Drilling Wastes," *JPT*, pp. 1081-1085 (Nov. 1993).
Minton, "A Novel Retrofit Solution for Oily Cuttings Slurrying and Re-Injection on the Ula Platform," SPE 35951, *Society of Petroleum Engineers*, pp. 519-525 (1996).

* cited by examiner

RECLAMATION OF COMPONENTS OF WELLBORE CUTTINGS MATERIAL

CROSS-REFERENCE TO RELATED APPLICATIONS

This Application is a division of U.S. patent application Ser. No. 11/543,301 filed on Oct. 4, 2006 now abandoned and incorporated by reference herein for all it contains.

BACKGROUND OF THE INVENTION

1. Field of the Invention

The present invention is directed to systems and methods for reclaiming components of wellbore drilling cuttings mixtures; and in one aspect, to transferring dried lean phase cuttings materials to other systems.

2. Description of the Related Art

Drilling fluids—typically called "muds"—used in hydrocarbon well drilling, as well known in the prior art, pick up solid cuttings and debris which must be removed if the fluid is to be re-used. These fluids are typically water based or oil-based. Often a mud with various additives is pumped down through a hollow drill string (pipe, drill collar, bit, etc.) into a wellbore and exits through holes in a drillbit. The mud picks up cuttings, rock, other solids, and various contaminants, such as, but not limited to, crude oil, water influx, salt and heavy metals from the well and carries them upwardly away from the bit and out of the well in a space between the well walls and the drill string. The mud is pumped up the wellbore and at the top of the well the contaminated solids-laden mud is discharged, e.g., to a shale shaker which has a screen or a series of screens that catch and remove solids from the mud as the mud passes through them. If drilled solids are not removed from the mud used during the drilling operation, recirculation of the drilled solids can create weight, viscosity, and gel problems in the mud, as well as increasing wear on mud pumps and other mechanical equipment used for drilling. The prior art discloses a variety of drill cuttings treatment methods and systems, and methods for reinjecting processed drilling fluid back into a well, including, but not limited to, as disclosed in U.S. Pat. Nos. 4,942,929; 5,129,469; 5,109,933; 4,595,422; 5,129,468; 5,190,645; 5,361,998; 5,303,786; 5,431,236; 6,640,912; 6,106,733; 4,242,146 and 4,209,381—all of these patents incorporated fully herein for all purposes. In one example of a typical prior art system, land-based or offshore (e.g. as shown in U.S. Pat. No. 5,190,645), a well is drilled by a bit carried on a string of drill pipe as drilling mud is pumped by a pump into the drill pipe and out through nozzles in the bit. The mud cools and cleans the cutters of the bit and then passes up through the well annulus flushing cuttings out with it. After the mud is removed from the well annulus, it is treated before being pumped back into the pipe. The mud enters a shale shaker where the relatively large cuttings are removed. The mud then enters a degasser where gas can be removed if necessary. The degasser may be automatically turned on and off, as needed, in response to an electric or other suitable signal produced by a computer and communicated to degasser. The computer produces the signal as a function of data from a sensor assembly associated with shale shaker. The mud then passes to a desander and (or a desilter), for removal of smaller solids picked up in the well. In one aspect, the mud next passes to a treating station where, if necessary conditioning media, such as barite, may be added. Suitable flow controls e.g. a valve, control the flow of media. The valve may be automatically operated by an electric or other suitable signal produced by the computer as a function of the data from sensor assembly. From the treatment station, the mud is directed to a tank from which a pump takes suction, to be re-cycled through the well. The system shown is exemplary; additional components of the same types (e.g. additional treatment stations) or other types (e.g. centrifuges) are being included.

In another prior art system (e.g. as disclosed in U.S. Pat. No. 6,106,733) cuttings, debris, material, soil and fluid from a drilling operation in a wellbore W are conveyed to a shaker system. Separated oily solids (cuttings, soil, etc.) are conveyed with a conveyor (a pump may be used) to a thermal treatment system. The thermal treatment system produces a discharge of treated solids suitable for disposal and a stream containing liquids (e.g. oil and water).

In certain prior art systems and methods on an offshore rig wet cuttings, produced, e.g., by shale shakers, are mixed with sea water to form a mixture with a desired mud weight and viscosity which, in some aspects, results in a pumpable slurry. The resulting drilling fluid is then fed to a known cuttings reinjection system or to storage. Wet material generally weighs more and can occupy more volume than dry material.

A variety of problems are associated with certain prior art systems and methods which begin with wet drilling material, "wet" being defined as the fluid content of material taken directly from shale shakers. Cohesive bridging and arching of wet material are problems associated with attempts to process wet material to recover reusable drilling fluid.

There has long been a need for an effective and efficient system for treating drilling mixtures to recover reusable fluid and to process cuttings material for transfer and, in some cases, for reinjection into the earth. There has long been a need, recognized by the present inventor, for such systems which deal with dry drill cuttings material so it can be effectively handled and reinjected into the earth and which reduce the volume of cuttings material for ease of handling and economies of scale.

BRIEF SUMMARY OF THE INVENTION

The present invention teaches methods for reclaiming component materials from a drill cuttings mixture of drilling fluid and cuttings material, the methods in certain aspects including: flowing a drill cuttings mixture of drilling fluid and cuttings material to a dryer; producing with the dryer dry cuttings material; and conveying with a conveyor system the dry cuttings material to a secondary system, the conveyor system including a positive pressure pneumatic conveying apparatus for conveying the dry cuttings material to the secondary system.

The present invention teaches systems for separating drilling mixture components and for reinjecting cuttings material into a wellbore, the systems in certain aspects including: a dryer for producing dry cuttings material from a cuttings mixture of drilling fluid and cuttings material, the dryer in certain aspects for reducing in size pieces of material fed to it and, in one aspect, reducing material to powder; and a conveying system for conveying the dry cuttings material to a secondary system, e.g. a thermal treatment system or a reinjection apparatus, the conveying system including positive pressure pneumatic conveying apparatus.

The present invention discloses, in certain embodiments, a wellbore cuttings component reclamation system that processes cuttings material from a wellbore drilling mixture and treats the cuttings material to produce acceptably disposable material (in certain aspects for transfer to a thermal treatment facility and subsequent landfill disposal; or for reinjection, e.g. into a dedicated reinjection well or through an open annulus of a previous well into a fracture, e.g. a fracture created at a casing shoe set in a suitable formation and, in certain aspects, recyclable drilling fluid. Such systems may be land-based or configured for offshore use.

In certain embodiments, a system according to the present invention has cuttings material processed by a dryer, e.g. a vortex dryer, that produces relatively dry material containing primarily drill cuttings material and some drilling fluid. In one aspect "dry" material is material that is a powder-like substance able to be transferred or conveyed in lean (or "dilute") phase (i.e. substantially all particulates contained in an air stream are airborne), facilitating transfer by a positive pressure pneumatic conveyor. Using a dryer that produces both dried cuttings material and drilling fluid can, according to the present invention, optimize or maximize the reclamation of drilling fluid ("mud") and minimize the volume of cuttings material to be transported and/or treated prior to disposal. In certain aspects, by passing the cuttings material through a Vortex dryer or similar apparatus, the size of pieces of cuttings material is reduced and the transfer of such material is thereby facilitated; in one aspect, a Vortex dryer produces a powder from input cuttings material. In many instances, additional grinding of the material by an appropriate grinder apparatus facilitates treatment of the material by a shaker. Broken down material is slurrified more easily than relatively larger material; e.g., when, for reinjection, the material is mixed with seawater. By using a dryer that reduces size of material, wear and tear on downstream grinders is reduced. Using a positive pressure pneumatic conveying apparatus, dried cuttings material can be dosed into a treatment facility in a controlled manner.

Accordingly, the present invention includes features and advantages which are believed to enable it to advance drill cuttings conveyance technology. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain preferred embodiments of the invention, there are other objects and purposes which will be readily apparent to one of skill in this art who has the benefit of this invention's teachings and disclosures. It is, therefore, an object of at least certain preferred embodiments of the present invention to provide:

New, useful, unique, efficient, non-obvious systems and methods for the reclamation of drilling material components and which treat drill cuttings material to produce conveyable dry drill cuttings material conveyable by positive pressure pneumatic conveying apparatus on land-based or offshore drilling rigs;

Such systems and methods that provide for further treatment and/or processing of relatively dry cuttings material, including, but not limited to reinjection and thermal treatment; and Such systems and methods that reclaim re-usable re-cyclable drilling fluids.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention in any way.

It will be understood that the various embodiments of the present invention may include one, some, or all of the disclosed, described, and/or enumerated improvements and/or technical advantages and/or elements in claims to this invention.

BRIEF DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or equivalent embodiments.

Figure 1:
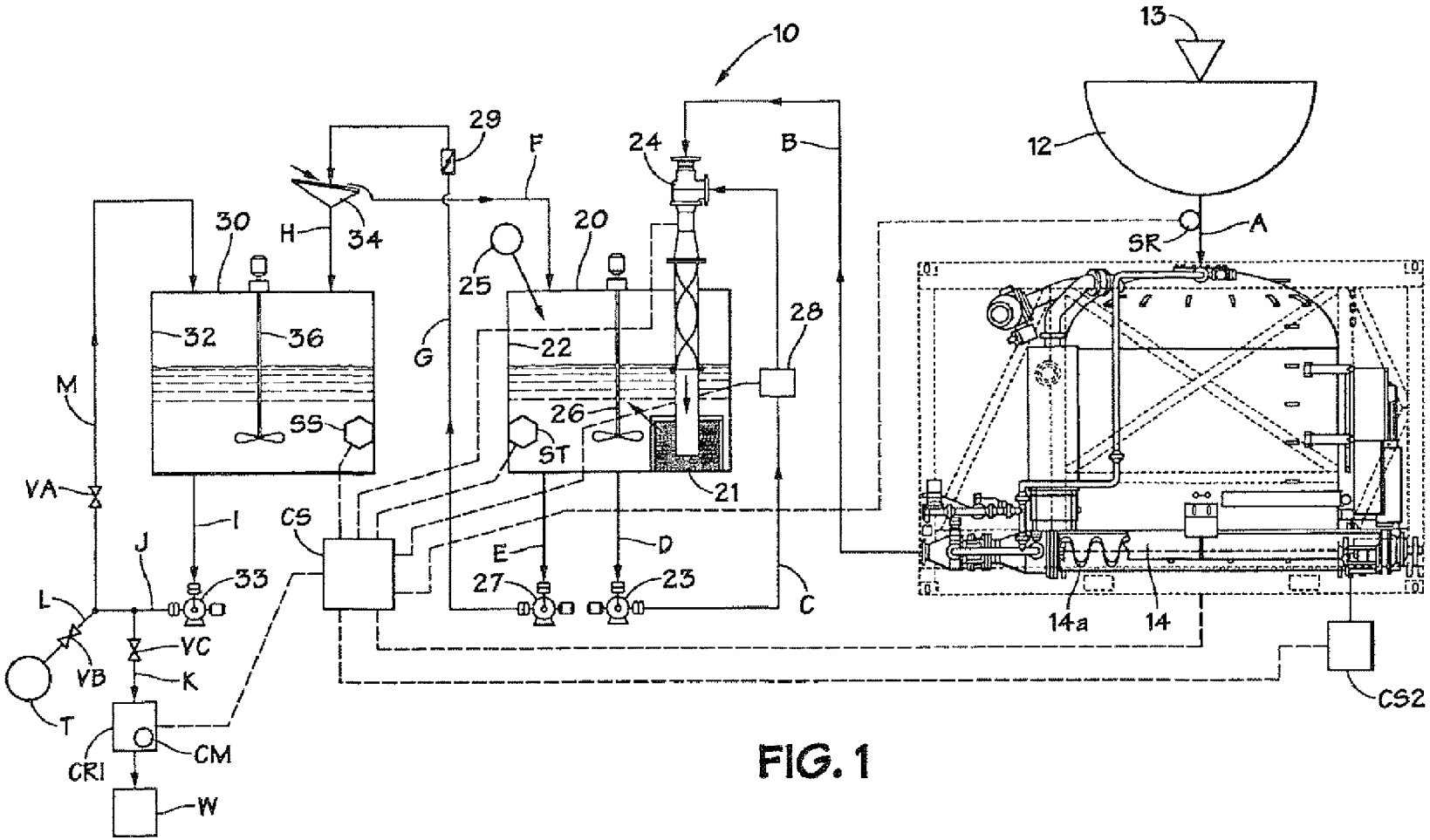
FIG. 1 is a schematic view of a system according to the present invention.

Presently preferred embodiments of the invention are shown in the above-identified figures and described in detail below. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference.

DETAILED DESCRIPTION OF THE INVENTION AND THE PREFERRED EMBODIMENT

As shown in FIG. 1, one particular embodiment of a system 10 according to the present invention has a system 12 with a dryer 13 for producing dry cuttings material and then feeding the dry cuttings material in a line A to a system 14, a positive pressure pneumatic conveying system that selectively conveys the dry material into the line B (for eventual reinjection). In one particular aspect the system 14 is a system as disclosed in co-owned U.S. Pat. Nos. 6,936,092 and 6,988,567 and U.S. application Ser. No. 10/875,083 filed Jun. 22, 2004, all incorporated fully herein for all purposes. In one aspect the dryer produces dried cuttings material in a powder-like form.

A sensor SR on the line A senses moisture content of the material in the line and conveys this information to a control system CS (e.g., but not limited to a control system as disclosed in the co-owned patents and U.S. patent applications listed above) which can shut down flow from the system 12. The control system CS controls the various items, devices and apparatuses in the system 10 and, in one aspect, communicates with a control system CM of a cuttings reinjection system CRI. The control system CS can adjust the flow rate of dried material to a blender 24 using a standard PID algorithm with a setpoint based on acceptable density, feedback for which is obtained from a meter of the CRI system.

Material in a line B is conveyed to the blender 24. Water (or sea water) from a tank 22 is circulated in lines D and C to the blender 24 by a pump 23. The pump 23 pumps liquid from the tank 22 which mixes with the inflowing air flow from the line B in the blender 24. A viscosity/density meter 28 provides the control system CS with information regarding the viscosity and density of the material flowing from the tank 22. The cuttings material and water mix together and are pumped by the pump 23 through a screen 21 into the tank 22 of a first stage 20 of the system 10.

Water (or sea water) as needed is fed into the tank 22 by a pumping system 25. An agitator 26 helps maintain solids in suspension in the tank 22.

Density (and weight) and viscosity of the mixture in the tank 22 are sensed by sensors (e.g. meter 28, sensor ST) which convey sensed levels of density, weight, and viscosity to the control system CS, and, as needed, are adjusted by changing the feed from the system 14 using a control system CS 2 for the system 14 with the control system CS in communication with the control system CS 2. A resulting slurry of the material is pumped by a pump 27 in a line E to a line G to a tank 32 or, optionally, first to a shaker system 34. A control valve 29 selectively controls flow in the line G. When the tank's contents are at an acceptable density and/or viscosity, the valve 29 is opened, flow in Line B ceases, and the tank is emptied into the line G sending a batch of material to the tank 32. The shaker system 34 removes oversize solids returned in a line F back to the tank 22; and drilling fluid with particles of material of an acceptable size (which pass through the shaker's screens) is fed in a line H to the tank 32 of a second stage 30. Sensors SS sense levels of density, weight and viscosity of the material in the tank 32 and convey this information to the control system CS. As needed, weight and viscosity are adjusted. An agitator 36 agitates the contents of the tank 32. A discharge rate of the system 14 is adjustable via adjusting a variable speed metering screw 14*a* of the system 14.

Drilling fluid is pumped in lines I, J and K by a pump 33 for injection into a wellbore W e.g., for drilling operations employing pumped drilling fluid with valves VA and VB closed and valve VC open. Optionally, the pump 33 pumps material to the cuttings reinjection ("CRI") system which may include a or several first stage booster pump(s) for a or several triplex pump(s) or similar pump(s) useful in cuttings reinjection.

Optionally, with valves VA and VC closed, the material from the tank 32 is pumped by the pump 33 in the line I, J, L to a storage facility T. Optionally with the valves VA and VC closed, the pump 33 pumps material from the tank 32 in the lines I, J, M back into the tank 32 for storage and/or further processing.

Figure 2:
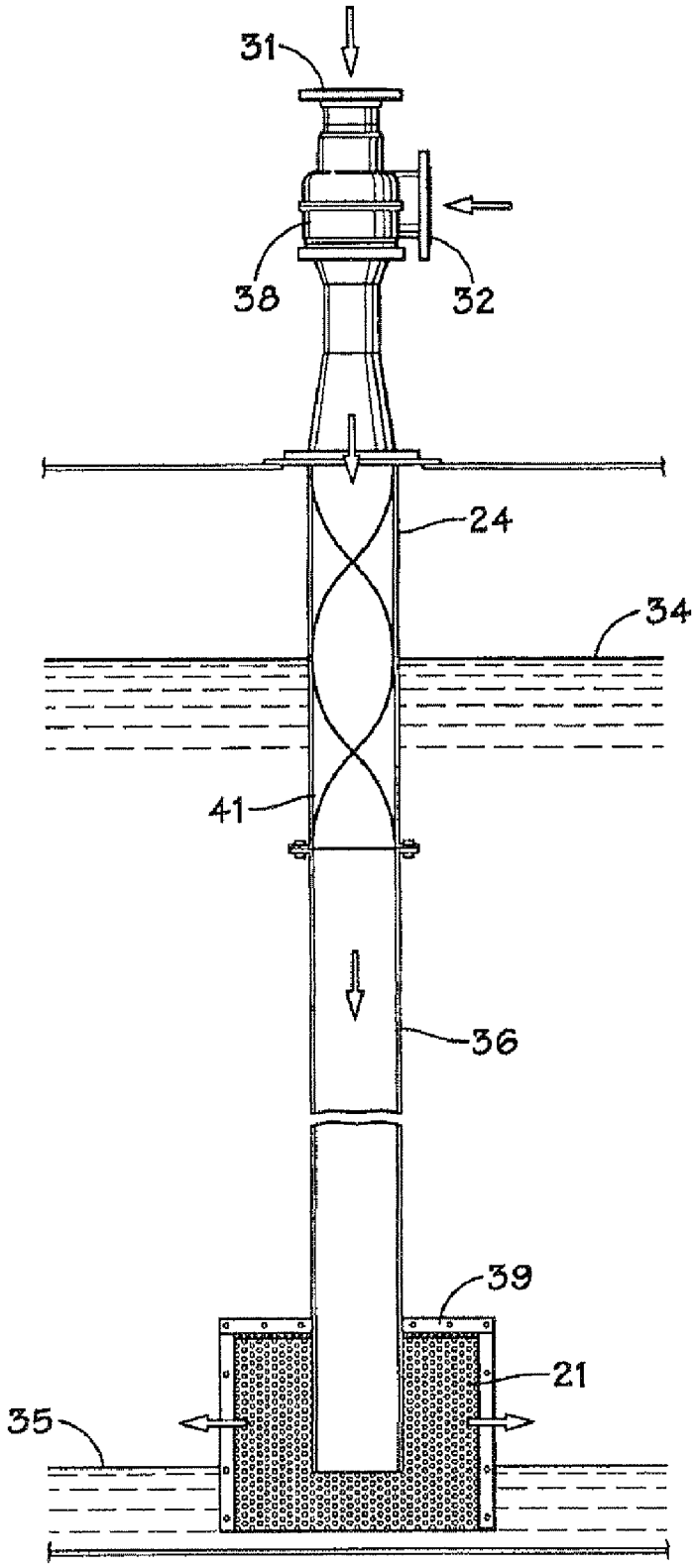
FIG. 2 is a side view in cross-section of part of the system of FIG. 1 showing a mixer.
Figure 3:
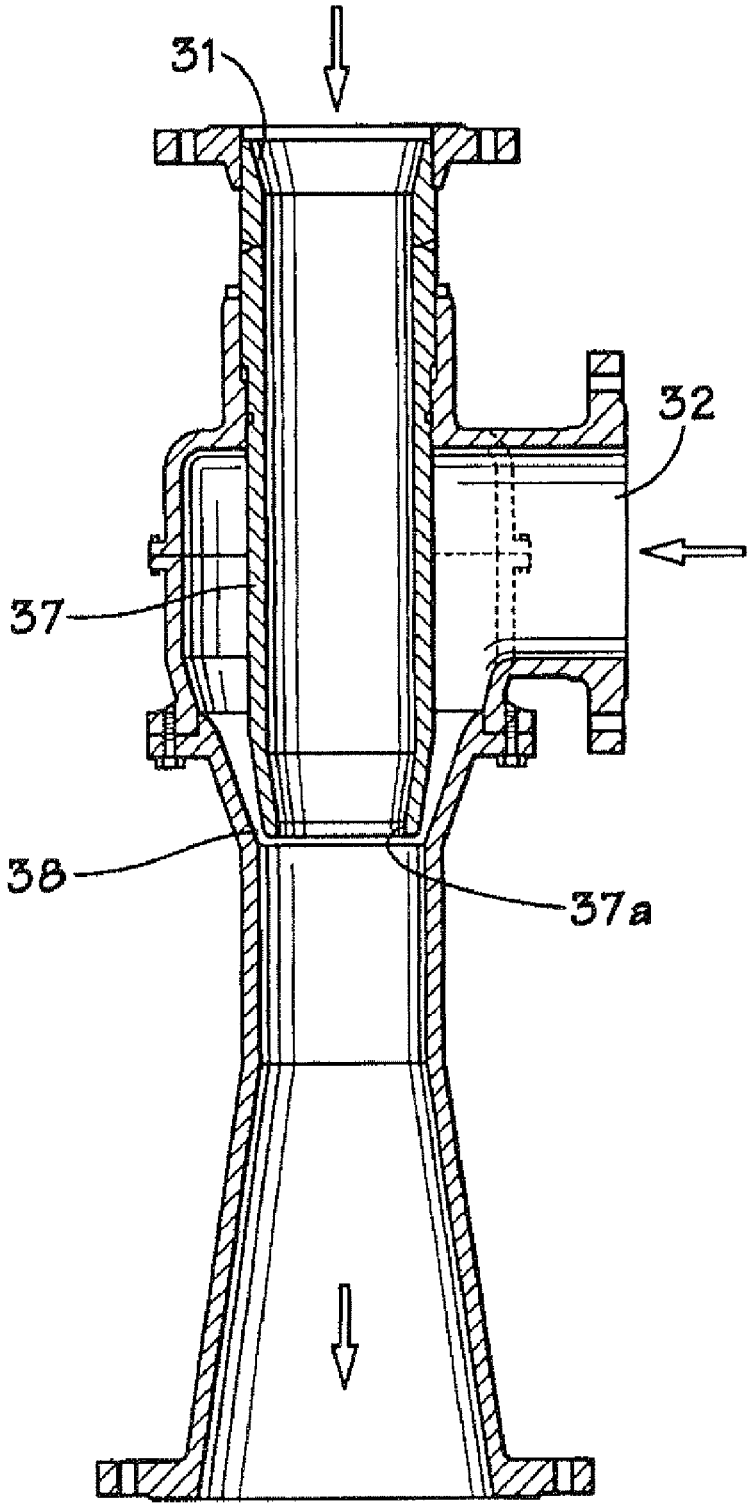
FIG. 3 is a side view in cross-section of part of the mixer in FIG. 2.

Any suitable known blender or mixer can be used for the blender 24 (e.g. a high shear mixing unit or mixer). In one aspect, as shown in FIGS. 2 and 3, the blender 24 has an inlet 31 in an upper body 38 into which dry material flows from the system 14, e.g. in a continuously flowing air-conveyed stream. Liquid recirculated from the tank 22 flows into an inlet 32, sucking material from the inlet 32. A mixer 41, e.g. an in-line static ribbon mixer, mixes the various flows. The material flows down a pipe 36 to a diffuser 39 which has a screen (or screens) 21 through which the material flows into the tank 22. Numeral 34 indicates a typical level of material in the tank 22 and numeral 35 indicates a low level of the material. Dried material from the dryer 13 is reduced in size by the dryer. This lightens the load on downstream grinders and increases the efficiency of the blender 24 and results in a focused high energy interaction between the relatively smaller solids (in powder form) and water (e.g. seawater), optimizing or maximizing resultant homogeneity of the mixture fed to the tank 22. Wear, tear and downtime of downstream grinders, e.g. grinder pumps of a CRI system are reduced due to the flow of the size-reduced material from the dryer.

As shown in FIG. 3 the body 38 includes an interior flow member 37 through which the dry material flows and exits from an outlet 37*a* to mix with the incoming liquid flowing in from the inlet 32.

Figure 4:
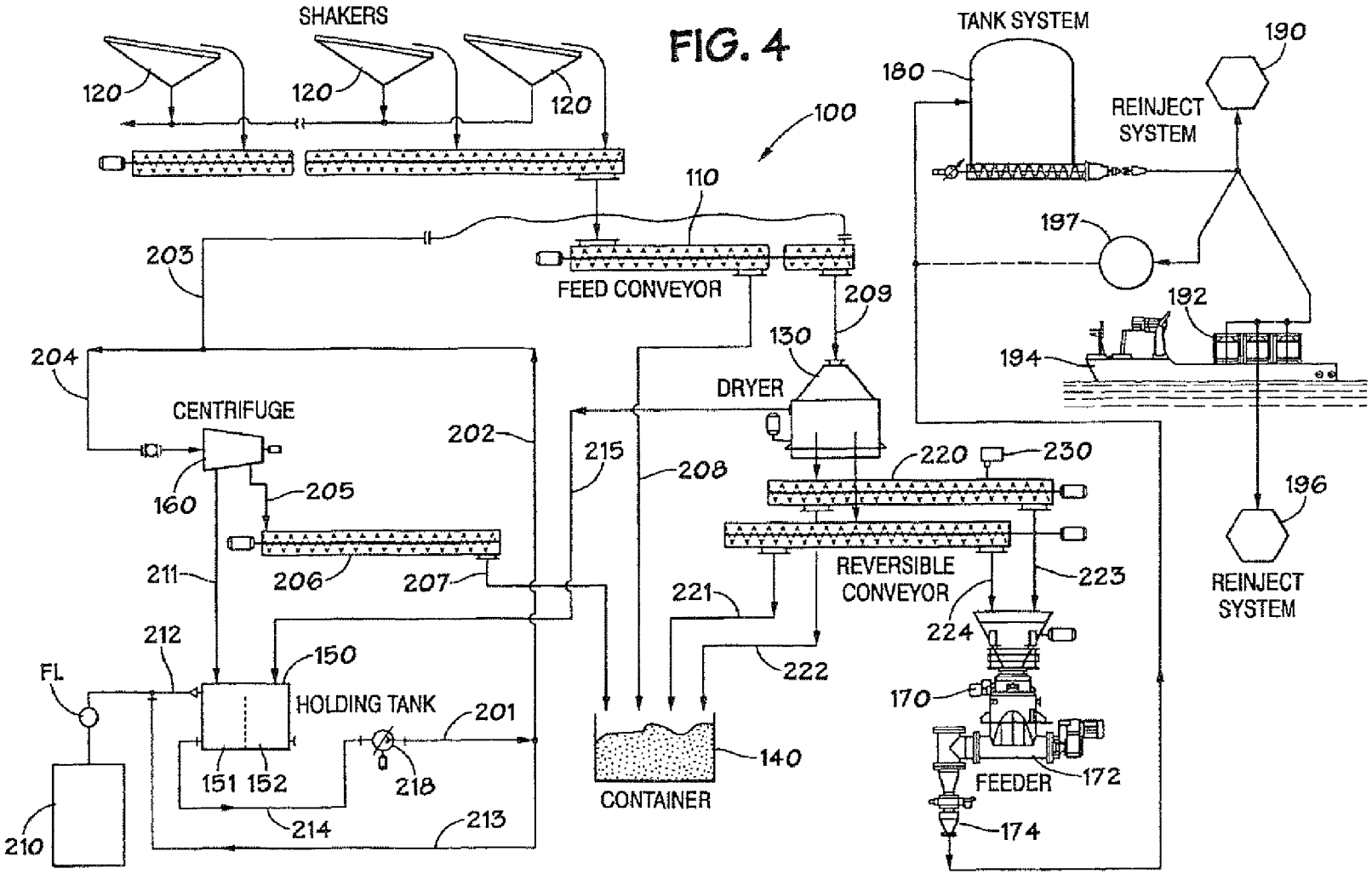
FIG. 4 is a schematic view of a system according to the present invention.

FIG. 4 illustrates a system 100 according to the present invention in which a feed conveyor 110 conveys drill cuttings material processed by shakers 120 (e.g. on a land rig or offshore rig) either to a dryer 130 or to a cuttings container 140. Recovered well drilling fluid (with some solids) from the dryer 130 is, optionally, fed in a line 215 to a holding tank 150 and then to a centrifuge 160 for centrifugal processing. Dried cuttings material from the dryer 130 is fed by a compressor system 220 to a feeder system 170 (a positive pressure pneumatic conveying system), with a feeder 172 and an outlet 174, to a tank system 180 from which it is fed to a cuttings reinjection system 190.

Optionally, cuttings material from the tank system 180 is fed to a storage system 192 on a vessel 194 from which it is subsequently introduced to a cuttings reinjection system 196 at another site or rig. The system 170 can does the material to the tank system 180 and/or the tank system 180 can does the material to the system 190. The system 100 may have a control system like the system CS, FIG. 1.

In one particular aspect the dryer 130 is a vortex dryer, e.g. a commercially available National Oilwell Varco Brandt Vortex Dryer which, optionally, can be flushed with liquid material from the holding tank 150 via lines 201, 202, 203. Via lines 201, 202 and 204 material from the tank 150 is fed to the centrifuge 160. Solids output by the centrifuge 160 flow in a line 205 to a conveyor 206 which transfers the solids in a line 207 to the container 140. The holding tank 150 is a weir tank with a middle weir dividing the tank into two sides 151, 152.

The feed conveyor 110 feeds material in a line 208 to the container 140 and in a line 209 to the dryer 130. Recovered material flows from the dryer 130 to the tank 150 in a line 215. Drilling fluid from the centrifuge 160 flows in a line 211 back to the tank 150. Reusable drilling fluid flows from the tank 150 in a line 212 to a rig mud system 210. Optionally, this fluid flows through a filtration system FL prior to introduction to the system 210. Material in a line 214 from a side 151 of the tank 150 is fed back to the centrifuge in a line 201. Material flows in a line 213 to the line 212. A pump 218 pumps material in the line 201.

The system 170, which receives dry material from the dryer 130, including a positive pressure pneumatic conveying system, including, e.g., those disclosed in the two U.S. patents and the pending U.S. patent application referred to above. Dry material from the dryer 130 is fed by the reversible conveyor 220 to the system 170 in lines 223, 224. A moisture meter 230 measures the moisture level of material from the dryer 230 and, if the material's moisture content exceeds a pre-set level (e.g. 10% by weight)—a level at which conveyance by the positive pressure pneumatic conveying apparatus would be impeded or prevented—the reversible conveyor 220 reverses and the material is fed in the lines 221, 222 to the container 140. In one aspect the dryer is a vortex dryer that produces the dry cuttings material as dry powder in lean phase.

Suitable valves, check valves, filters, flow controllers and controls for them are used on the lines of the system 100.

Dry material from the system 170 is moved, in one aspect, to a suitable storage and processing system, e.g. a tank system 180 which may be any tank or vessel (or tanks or vessels) disclosed in the two U.S. patents and the U.S. patent application referred to above, including a vessel (land-based; on a rig; on a ship) which doses material to an apparatus or system (e.g. to the system 190 or to the system 196). The reinjection systems 190 and 196 may be like that of FIG. 1 or they may be any suitable known cuttings reinjection system for reinjecting material into a wellbore.

In one particular aspect, if the moisture sensor 230 indicates that screens in the dryer 130 are blinding (indicating the moisture content of the material is too high for the conveying system to convey or to effectively convey the material), material from the dryer 130 is directed in the line 222 to the container 140. Optionally, material from the system 170 is fed to a thermal treatment system 197 (from which it can then be transferred to the system 190 or to a transport for transfer to the system 196. As with the transfer of material to the system 190, material can be sent directly from the system 170 to the system 197, or to the system 180 and then to the system 197.

The present invention, therefore, provides in some, but not necessarily all, embodiments a method for reclaiming component materials from a drill cuttings mixture of drilling fluid and cuttings material, the method including: flowing a drill cuttings mixture of drilling fluid and cuttings material to a dryer; producing with the dryer dry cuttings material; and conveying with a conveyor system the dry cuttings material to a secondary system, the conveyor system including a positive pressure pneumatic conveying apparatus for conveying the dry cuttings material to the secondary system. Such a method may include one or some, in any possible combination, of the following: wherein the secondary system is a cuttings reinjection system, the method further including reinjecting the dry cuttings material into a wellbore using the cuttings reinjection system; sensing moisture content of the dry cuttings material; if the moisture content indicates that the dry cuttings material will impede conveyance by the conveyor system, diverting the dry cuttings material away from the positive pressure pneumatic conveying apparatus; producing with the dryer a drilling fluid mixture with some solids from the drill cuttings mixture, and flowing the produced drilling fluid mixture from the dryer with some solids to a holding system; flowing the drilling fluid mixture from the holding system to a rig mud system; flowing drilling fluid mixture from the holding system to a centrifuge for processing by the centrifuge to produce centrifuged solids and centrifuged drilling fluid; flowing the centrifuged drilling fluid to the holding system; the conveyor system including a reversible conveyor, the method further including reversing the reversible conveyor to prevent dry drill solids from the dryer from flowing to the positive pressure conveying apparatus; wherein the secondary system is a thermal treatment system, the method further including treating the dry cuttings material with the thermal treatment system; dosing material from the positive pressure pneumatic conveying apparatus to the secondary system; wherein a primary control system controls operations of the system and a secondary control system controls the cuttings reinjection system, the secondary control system in communication with the primary control system, the method further including adjusting using the primary control system a rate of feed of material to a mixer, and feeding material from the mixer to the cuttings reinjection system; wherein the secondary control system provides density measurements from a density meter to the primary control system, the primary control system taking said measurements into account in said adjusting; wherein the cuttings material includes pieces of material, each piece having a size, the method further including the dryer reducing the size of said pieces; and/or wherein the dryer reduces the pieces to powder.

The present invention, therefore, provides in some, but not necessarily all, embodiments a method for reclaiming component materials from a drill cuttings mixture of drilling fluid and cuttings material, the method including: flowing a drill cuttings mixture of drilling fluid and cuttings material to a dryer; producing with the dryer dry cuttings material; conveying with a conveyor system the dry cuttings material to a reinjection system, the conveyor system including a positive pressure pneumatic conveying apparatus for conveying the dry cuttings material; reinjecting the dry cuttings material into a wellbore using the reinjection system; sensing moisture content of the dry cuttings material; the conveyor system having a reversible conveyor, the method further including if the moisture content of the dry cuttings material is of such a level that conveyance by the conveyor system would be impeded, reversing the reversible conveyor to prevent dry cuttings material from the dryer from flowing to the positive pressure conveying apparatus.

The present invention, therefore, provides in some, but not necessarily all, embodiments a system for separating drilling mixture components and for reinjecting cuttings material into a wellbore, the system including: a dryer for producing dry cuttings material from a cuttings mixture of drilling fluid and cuttings material; a conveying system for conveying the dry cuttings material to a reinjection apparatus, the conveying system having positive pressure pneumatic conveying apparatus; and a thermal treatment apparatus or a reinjection apparatus for reinjecting the dry cuttings material into a wellbore. Such a method may include one or some, in any possible combination, of the following: a moisture sensor for sensing moisture content of the dry cuttings material, and the conveyor system further having a reversible conveyor, the reversible conveyor for feeding the dry cuttings material to the positive pressure pneumatic conveying apparatus and for reversing, if the moisture content of the dry cuttings material is such that conveyance by the positive pressure pneumatic conveying apparatus would be impeded, so that the dry cuttings material do not flow to the positive pressure pneumatic conveying apparatus; a centrifuge for receiving a drilling fluid stream from the dryer, the drilling fluid stream containing reclaimable drilling fluid, and the centrifuge for processing the drilling fluid stream from the dryer producing reusable drilling fluid; and/or wherein the dryer is for reducing in size the size of pieces of cuttings material, in one aspect, to powder.

In conclusion, therefore, it is seen that the present invention and the embodiments disclosed herein are well adapted to carry out the objectives and obtain the ends set forth. Certain changes can be made in the subject matter without departing from the spirit and the scope of this invention. It is realized that changes are possible within the scope of this invention and it is further intended that each element or step recited herein is to be understood as referring to the step literally and/or to all equivalent elements or steps. This specification is intended to cover the invention as broadly as legally possible in whatever form it may be utilized. All patents and applications identified herein are incorporated fully herein for all purposes.

What is claimed is:

1. A method comprising:

flowing a drill cuttings mixture comprising drilling fluid and cuttings material to a dryer, wherein said dryer is adapted to dry said cuttings material below a preselected moisture content level;

producing dried cuttings material from said drill cuttings mixture with said dryer;

sensing a moisture content of said dried cuttings material;

conveying said dried cuttings material to a cuttings reinjection system with a conveyor system comprising a positive pressure pneumatic conveying apparatus; and reinjecting said dried cuttings material into a well bore using said cuttings reinjection system.

2. The method of claim 1, further comprising diverting said dried cuttings material away from said positive pressure pneumatic conveying apparatus when said sensed moisture content exceeds said preselected moisture content level.

3. The method of claim 2, wherein diverting said dried cuttings material comprises reversing a reversible conveyor comprising said conveyor system to prevent said dried cuttings material from flowing to said positive pressure pneumatic conveying apparatus.

4. The method of claim 1, further comprising:

producing a drilling fluid mixture comprising some solids material from said drill cuttings mixture with said dryer; and flowing said drilling fluid mixture from said dryer to a holding system.

5. The method of claim 4, further comprising flowing said drilling fluid mixture from said holding system to a rig mud system.

6. The method of claim 4, further comprising flowing said drilling fluid mixture from said holding system to a centrifuge, wherein said centrifuge is adapted to produce centrifuged solids and centrifuged drilling fluid.

7. The method of claim 6, further comprising flowing said centrifuged drilling fluid to said holding system.

8. The method of claim 1, further comprising treating said dried cuttings material with a thermal treatment system.

9. The method of claim 8, further comprising feeding said dried cuttings material from said positive pressure pneumatic conveying apparatus to said thermal treatment system prior to reinjecting said dried cuttings material into said well bore.

10. The method of claim 1, further comprising:

using a primary control system to adjust a rate of feed of said dried cuttings material to a mixer, wherein said primary control system is adapted to control said conveyor system; and feeding mixed material from said mixer to said cuttings reinjection system.

11. The method of claim 10, wherein adjusting said feed rate of said dried cuttings material to said mixer comprises using a secondary control system to provide density measurements from a density meter to said primary control system, wherein said secondary control system is adapted to control said cuttings reinjection system.

12. The method of claim 10, further comprising reducing a size of material pieces comprising said cuttings material with said dryer.

13. The method of claim 12, wherein reducing said size of said material pieces comprises reducing said material pieces to powder.

14. The method of claim 1, further comprising setting said preselected moisture content level to approximately 10% by weight.

15. The method of claim 1, wherein sensing said moisture content of said dried cuttings material comprises using a moisture meter to measure said moisture content prior to conveying said dried cuttings material to said cuttings reinjection system.

* * * * *